US005915682A

United States Patent [19]

Ambühl et al.

[11] Patent Number: 5,915,682

[45] Date of Patent: Jun. 29, 1999

[54] SHEET FEEDER SYSTEM AND METHOD FOR INDIVIDUALLY SEPARATING SHEETS

[75] Inventors: Hermann Ambühl, Ostermundigen; Urs Flühmann, Bern, both of Switzerland; Martin Greive, Heidelberg; Bernd Hermann, Malsch, both of Germany; Hans Jöhr, Kehrsalz, Switzerland; Peter Lehmann, Kirchdorf, Switzerland; Rudolf Lüthi, Niederwangen, Switzerland

[73] Assignee: Heidelberger Druckmaschinen AG, Heidelberg, Germany

[21] Appl. No.: 08/759,826

[22] Filed: Nov. 21, 1996

[30] Foreign Application Priority Data

Nov. 21, 1995 [DE] Germany ..... 195 43 382

[51] Int. Cl.[6] ..... B65H 3/30

[52] U.S. Cl. ..... 271/21; 271/22; 271/161

[58] Field of Search ..... 271/19, 21, 22, 271/24, 161

[56] References Cited

U.S. PATENT DOCUMENTS

| | | | |
|---|---|---|---|
| 2,827,288 | 3/1958 | Geisler | 271/161 |
| 3,627,307 | 12/1971 | Van der Does | 271/19 |

FOREIGN PATENT DOCUMENTS

| | | | |
|---|---|---|---|
| 33 04 444 c2 | 8/1983 | Germany . | |
| 32 11 371 C2 | 10/1983 | Germany . | |
| 0247237 | 10/1988 | Japan | 271/21 |
| 1315090 | 6/1987 | U.S.S.R. | 271/19 |
| 1680606 | 9/1991 | U.S.S.R. | 271/161 |

OTHER PUBLICATIONS

Nishiyama, Page Turner, IBM Technical Disclosure Bulletin, vol. 18 No. 9, pp. 2923–2924, Feb. 1976.

*Primary Examiner*—H. Grant Skaggs
*Attorney, Agent, or Firm*—Herbert L. Lerner; Laurence A. Greenberg

[57] ABSTRACT

A sheet feeder system for a sheet-fed printing press includes a device for causing a sheet pile to sag at least partly in at least an upper region thereof, and at least two contact elements disposed in mutually spaced-apart relationship on an upper side of the sheet pile and having respective contact surfaces for pressing against the upper side of the sheet pile at least partly or temporarily, at least one of the contact elements being drivable so as to move the respective contact surfaces pressing against the upper side of the sheet pile towards and away from one another, respectively, for forming an interspace between the uppermost sheet of the sheet pile and a sheet immediately therebelow, and a method for individually separating sheets.

10 Claims, 8 Drawing Sheets

SHEET FEEDER SYSTEM AND METHOD FOR INDIVIDUALLY SEPARATING SHEETS

BACKGROUND OF THE INVENTION

Field of the Invention

A sheet feeder system of a sheet-fed printing press has a function of individually separating sheets which have been precisely prepiled on a sheet support board and of supplying them in succession to a feeder of the printing press. Mainly two sheet feeder systems for sheet-fed offset printing presses are known in the present state of the art, namely a system having a single-sheet feeder with a sucker bar, and a system having a shingle or stream feeder with a suction head.

In the case of a single-sheet feeder, the uppermost sheet of a sheet pile is pneumatically lifted at the leading edge thereof by a plurality of suckers fastened to a bar, and then taken over by feed grippers or transport rollers. The feed grippers or transport rollers guide each sheet individually to the feeder of the printing press. By adjusting the suction force, by changing the tilt of the suction bar and by the action of blast air blown against the leading edge of the pile, the single-sheet feeder may be adapted to different thicknesses of paper and different paper qualities. The instant the separated sheet has run into the printing press, a new sheet may be individually separated. Consequently, in the case of a single-sheet feeder, the sheets have to be separated individually very quickly in order to attain the intended press speed.

For higher press speeds, shingle or stream feeders are used wherein the sheets are singled out or individually separated at the trailing edge of the pile by a suction head. A stream-feeder has various pneumatic separating and forwarding or pull suckers which remove the uppermost sheet and continuously feed it to a feeding table. In addition, various blowing devices, stripping or separating brushes, stripping or separating plates and sheet retainers or downholders are disposed at the trailing edge of the feeder in order to ensure a trouble-free separation and to provide for a smooth and straight transport of the sheets which are disposed in an overlapping or shingled manner on the feeding table. During a brief stop at the feeder, each sheet is aligned so as to be in register. The pressman must precisely adjust the blast air and the suction air, as well as the aforementioned auxiliary equipment, to the respective printing material which is being used.

In conventional feeder systems, suction air and blast air, respectively, are required, and the higher the operating speed, the greater the number and the greater the efficiency of the suction devices and blowing devices are necessary, for a correspondingly high air consumption. The suction devices and blowing devices cause considerable noise, and the periodic switching-on and switching-off of the air flows and the motion of the suction heads in accordance with the press cycle result in the production of vibrations which are difficult to cope with.

SUMMARY OF THE INVENTION

It is accordingly an object of the invention to provide a sheet feeder system and a method for individually separating sheets having a high operating speed and requiring reduced expense and technical efforts with respect to suction devices and blowing devices, and reduced air consumption, respectively.

With the foregoing and other objects in view, there is provided, in accordance with one aspect of the invention, a sheet feeder system for a sheet-fed printing press, comprising a device for causing a sheet pile to sag at least partly in at least an upper region thereof, and at least two contact elements disposed in mutually spaced-apart relationship on an upper side of the sheet pile and having respective contact surfaces for pressing against the upper side of the sheet pile at least partly or temporarily, at least one of the contact elements being drivable so as to move the respective contact surfaces pressing against the upper side of the sheet pile towards and away from one another, respectively, for forming an interspace between the uppermost sheet of the sheet pile and a sheet immediately therebelow.

In accordance with another feature of the invention, the sheet feeder system includes a device engaging in the interspace formed between the uppermost sheet and the sheet therebelow.

In accordance with a further feature of the invention, the device engaging in the interspace comprises at least one movable gripper for seizing the uppermost sheet and drawing it off the sheet pile.

In accordance with an added feature of the invention, the device engaging in the interspace comprises at least one governor finger movable into the interspace in a contact-free manner and lowerable onto the respective sheet below the uppermost sheet.

In accordance with an additional feature of the invention, the at least one governor finger has a low-friction surface forming a counterpressure device for a friction wheel disposed above the at least one governor finger, the friction wheel being lowerable onto the uppermost sheet for transporting the uppermost sheet in a direction towards a feeder of the printing press.

In accordance with yet another feature of the invention, the feeder of the printing press includes at least one pair of transport rollers disposed proximately to the sheet pile.

In accordance with yet a further feature of the invention, the contact elements are friction wheels pre-loaded in a direction towards the upper side of the sheet pile.

In accordance with yet an added feature of the invention, a respective one of the friction wheels is disposed on each side of the sheet pile proximate to respective leading and trailing edges of the sheets thereof, the friction wheels being drivably supported on respective shafts extending transversely to the leading sheet edges and the trailing sheet edges, respectively.

In accordance with yet an additional feature of the invention, the device for causing the sheet pile to sag is a sheet support board having an at least partly convex or concave shape.

In accordance with another aspect of the invention, there is provided a method of individually separating sheets piled on top of one another in a feeder of a sheet-fed printing press, which comprises causing a sheet pile to sag at least partly in at least an upper region thereof, stretching or contracting an uppermost sheet of the sheet pile in the sagging region of the sheet pile by mechanical contact at the upper sheet side so as to form an interspace between the uppermost sheet of the sagging sheet pile and the sheet immediately therebelow.

In accordance with a further mode of the invention, wherein the sheet pile sags in a concave manner, the method includes pressing with at least one contact element on each side of the sheet pile against the upper side of the uppermost sheet, and laterally moving away from one another the surfaces of the contact elements pressing against the uppermost sheet so as to apply tension to the uppermost sheet.

In accordance with a concomitant mode, the method according to the invention includes forming the interspace on a side of the sheet pile which is remote from the feeder of the sheet-fed printing press, engaging in the interspace formed between the uppermost sheet and the sheet immediately therebelow so as to retain the respective sheet below the uppermost sheet, mechanically conveying the uppermost sheet in a direction towards the printing press and transferring the uppermost sheet to the printing press, and beginning the foregoing steps anew while the last individually separated sheet is still being drawn off the sheet pile.

The sheet pile lying on a sheet support board is provided with an arched or sagging shape beforehand, preferably by providing a sheet support board which does not have a flat or planar shape. A concave form of the sheet pile, at least in the upper region thereof, may alternatively be achieved by having, for example, entrainer members partly lifting the sheet pile at the sides of the sheet pile lying flatly on the sheet support board. It is sufficient to produce the arch in the sheet pile on the press side or on the side facing away from the press. If a convex arch is desired, under certain circumstances, one may possibly make use of the arch which a sheet pile often forms by itself.

A plurality of contact elements press on the uppermost sheet, the contact elements being preferably disposed in the proximity of the lateral sheet margins and having contact surfaces contacting the sheet. In the case of a convex arch, the contact elements and the contact surfaces, respectively, are moved towards one another. The uppermost sheet is thereby partly lifted from the sheet pile, so as to produce an interspace between the uppermost sheet and the remaining sheet pile.

If a concavely sagging sheet pile is used, the contact surfaces are moved away from one another, thereby stretching the uppermost sheet. The sheet stretching offers the advantage that even thin papers may be reliably separated. Moreover, the dimensions of the interspace which is produced are very well defined. This is advantageous if the produced interspace is used to completely release the sheet from the sheet pile and to feed it to the printing press. Hereinafter, different embodiments are described.

In an embodiment wherein the sheet pile sags in the vicinity of the leading or front side thereof, i.e., the side of the sheet pile facing towards the printing press, it is conceivable to provide, for example, grippers which seize the leading sheet edge. The grippers draw the uppermost sheet off the sheet pile and transfer it to the printing press, while the remaining sheets are retained by a stop. Because the contact elements lift the uppermost sheet off the sheet pile only partially, the position thereof is precisely defined the instant the grippers seize it. Therefore, the transfer may be effected without an intermediate stop, for example, at the transport rollers which ensure an in-register transport of the sheet to the printing press in one pass. The course of the movement is thereby stabilized, and the press speed may be increased.

Another embodiment wherein the sheet pile does not sag at the front side thereof but rather in a rear region thereof permits even higher speeds. The contact elements lift the uppermost sheet off the pile in the rear region thereof, and one or more governor fingers retaining or holding the remaining sheets may be inserted in the interspace which is produced. This procedure may be performed at the rear side of the sheet pile and/or at the sides of the sheet pile in the rear region thereof. Rotating friction wheels may, for example, be used to transport the uppermost sheet to the printing press. Even before the sheet has been completely drawn off the pile, the governor finger or fingers may be loosened, the next sheet may be lifted with the aid of the contact elements, and the governor finger or fingers may be moved again into a position from which the next sheet is fed. Thus, the sheets may be fed to the printing press in close succession or even in a shingled or overlapping manner. Enough time remains yet for the moved components to assume their respective position. Therefore the course of movement may be such that the components are only very slightly accelerated. As a result thereof, the moved components and the drives therefor may be dimensioned for lighter duty, and vibrations are reduced.

A particularly advantageous further development of this embodiment is that such a governor finger which retains the remaining sheets simultaneously provides a counterpressure device for a friction wheel. The uppermost sheet is clamped between a low-friction surface of the governor finger which, for example, is polished, and the friction wheel, and the latter then transports the sheet reliably and virtually slip-free to the printing press. Because the friction coefficient between the friction wheel and the sheet is essentially greater than the friction coefficient between the sheet and the governor finger, the draw-off or withdrawal behavior remains constant, i.e., unchanged, for a long time.

In order to move the contact surfaces, respectively, towards and away from one another, it suffices to drive only one of the contact elements. However, arranging identical contact elements disposed opposite to each so as to form a symmetric drive reduces the risk that, when being lifted, the uppermost sheet is displaced on the pile. As an alternative, or in addition thereto, stationary or movable pile stops may be used to keep the sheet precisely aligned. If the sheets are drawn off the sheet pile by friction wheels, for example, which transfer the sheets to transport rollers, the sheets are fed to the printing press in-register and in a smooth and straight manner, thus dispensing with an alignment of the sheets prior to the entry thereof into the printing units.

The contact elements respectively stretching and contracting the respective uppermost sheet may, for example, be movable fingers engaging over the sheet pile from the side and having contact surfaces at the ends thereof. In the preferred embodiment, the contact elements are continuously or intermittently driven friction wheels, the surfaces of which form the contact surfaces and which resiliently press against the sheet surface. An appropriate adjustment of the contact pressures of the friction wheels permits an adaptation to different papers.

In order to prevent the friction wheels or other contact elements from hampering the transport of the lifted sheets to the printing press, the friction wheels or contact elements may be lifted and lowered again onto a respective sheet in accordance with the cycle of the printing press. In the case of friction wheels, this effect may also be achieved by using friction wheels which are mounted eccentrically and are driven in synchronism with the press cycle.

Whereas the aforementioned embodiments can operate completely without air and, thereby, at low cost and in a low-noise manner, other embodiments requiring a limited application of air are conceivable. Instead of using friction wheels, the uppermost sheet may, for example, be drawn off the pile by a forwarding or pull sucker, while the remaining sheets are reliably retained on the pile. It is also possible to use suction rollers instead of friction wheels, the suction rollers having a respective porous outer cylindrical surface and being provided with a respective vacuum inside so that the sheet adheres thereto. The engagement in the interspace formed between the uppermost sheet and the sheet immediately therebelow may also be effected by air or may be air-supported, if the dynamic flow behavior permits. Compared to the conventional feeder systems using large amounts of air, all of the aforementioned embodiments require no air or only very little air for the initial sheet separation; moreover, less suction devices and blowing devices, respectively, are needed.

Other features which are considered as characteristic for the invention are set forth in the appended claims.

Although the invention is illustrated and described herein as embodied in a sheet feeder system and method for individually separating sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
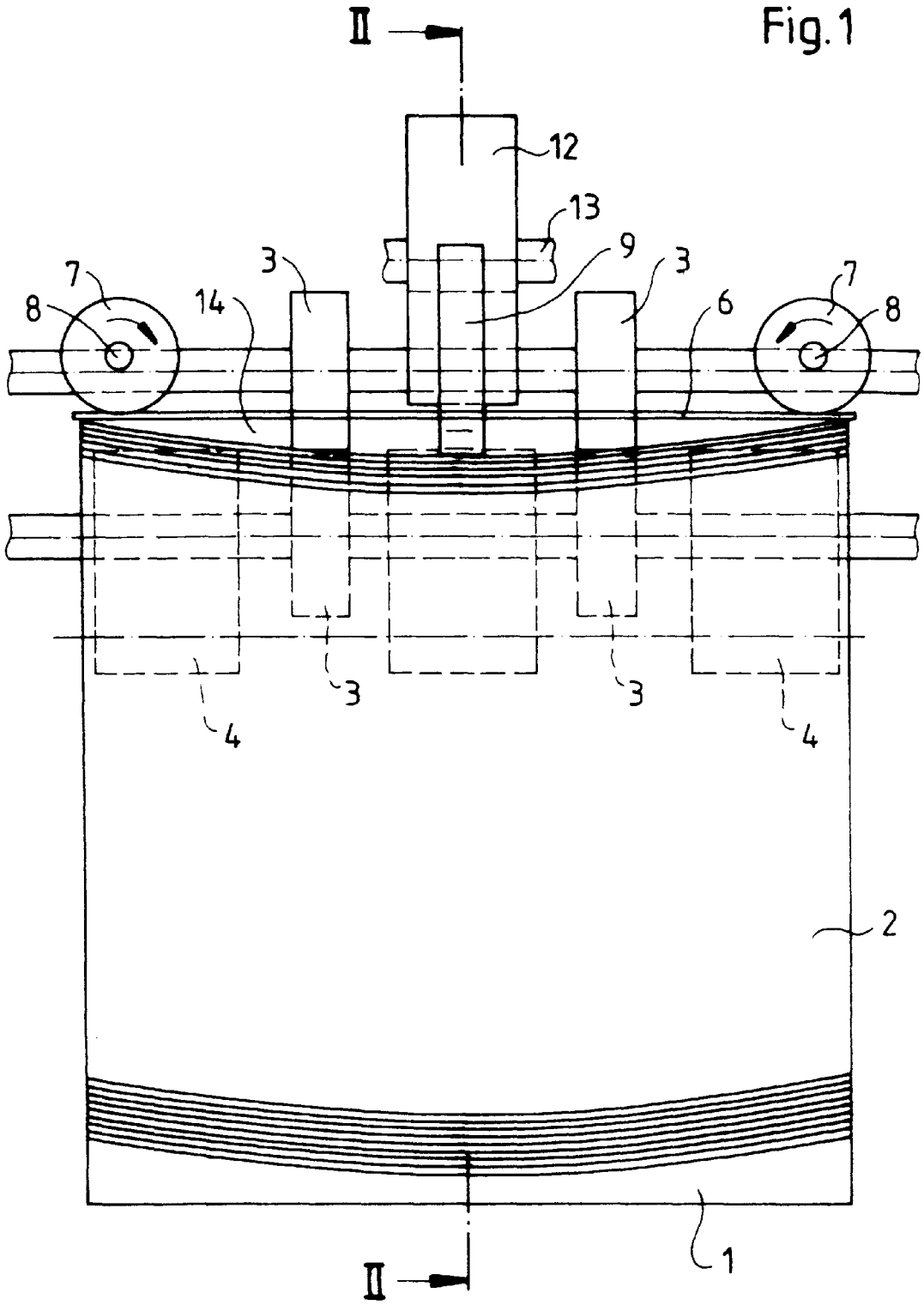
FIG. 1 is a diagrammatic rear elevational view of a sheet feeder system for a sheet-fed printing press.

Referring now to the drawings and, first, particularly to FIGS. 1 to 6 thereof showing an embodiment of a sheet feeder system according to the invention including a sheet support board 1 which is adjustable in height and a sheet pile 2 deposited on the sheet support board 1.

At the front side of the feeder system, i.e., on the opposite side of the sheet pile 2, as viewed in FIG. 1, there is located a printing press of which only transport rollers 3 are illustrated, the transport rollers 3 being journalled so as to be parallel to the leading edge of the sheet pile 2. Two respective pairs of transport rollers 3 having respective circumferences which adjoin one another along a line serve for transferring sheets to the printing press. Moreover, movable front pile stops 4 and stationary lateral pile stops 5 (FIGS. 2 to 6) are disposed at or near the front side of the sheet feeder system.

Figure 2:
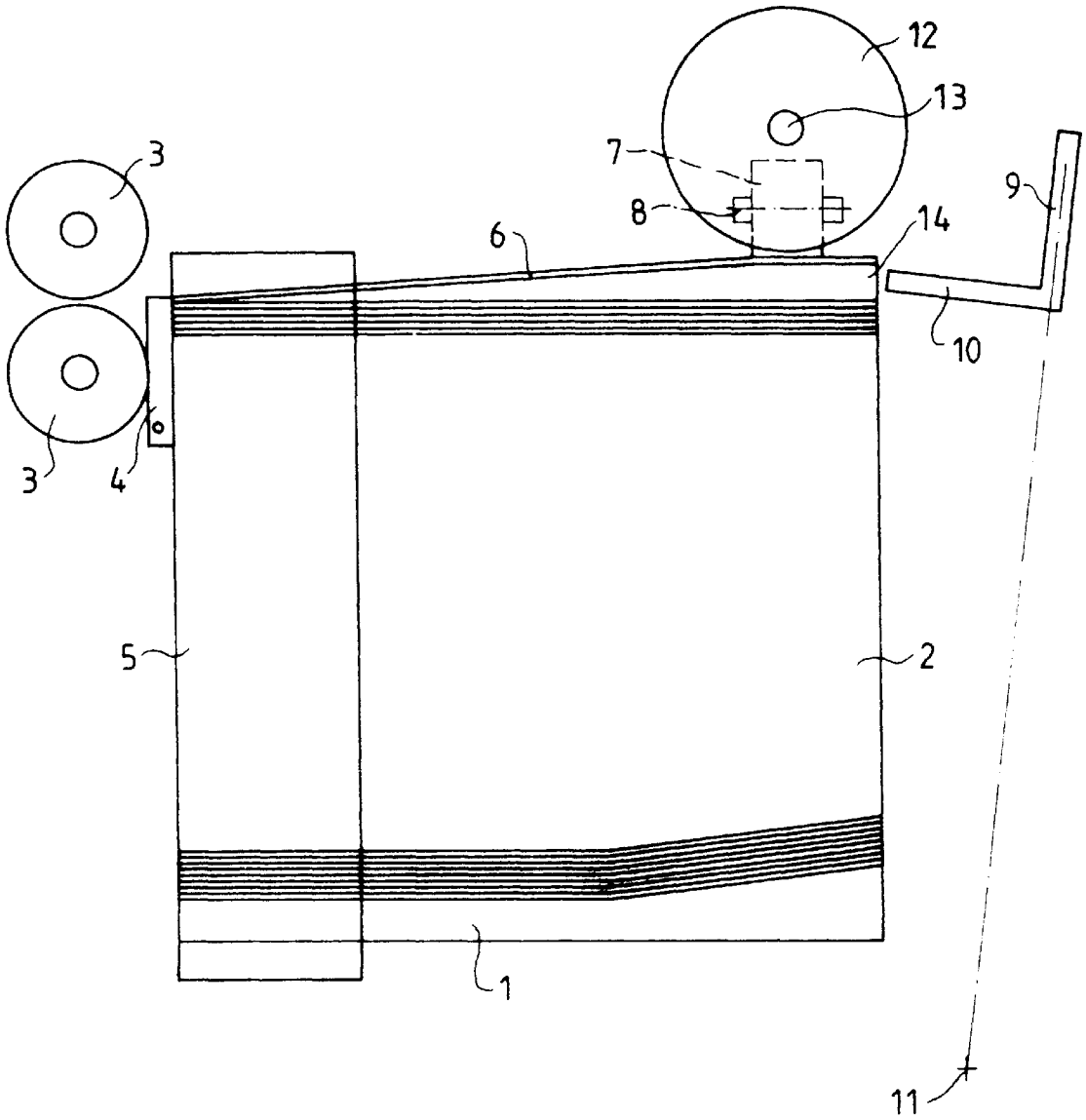
FIGS. 2 to 5 are diagrammatic cross-sectional views of FIG. 1 taken along the line II—II in the direction of the arrows, and showing the sheet feeder system in various operating phases of the sheet-separating cycle.
Figure 3:
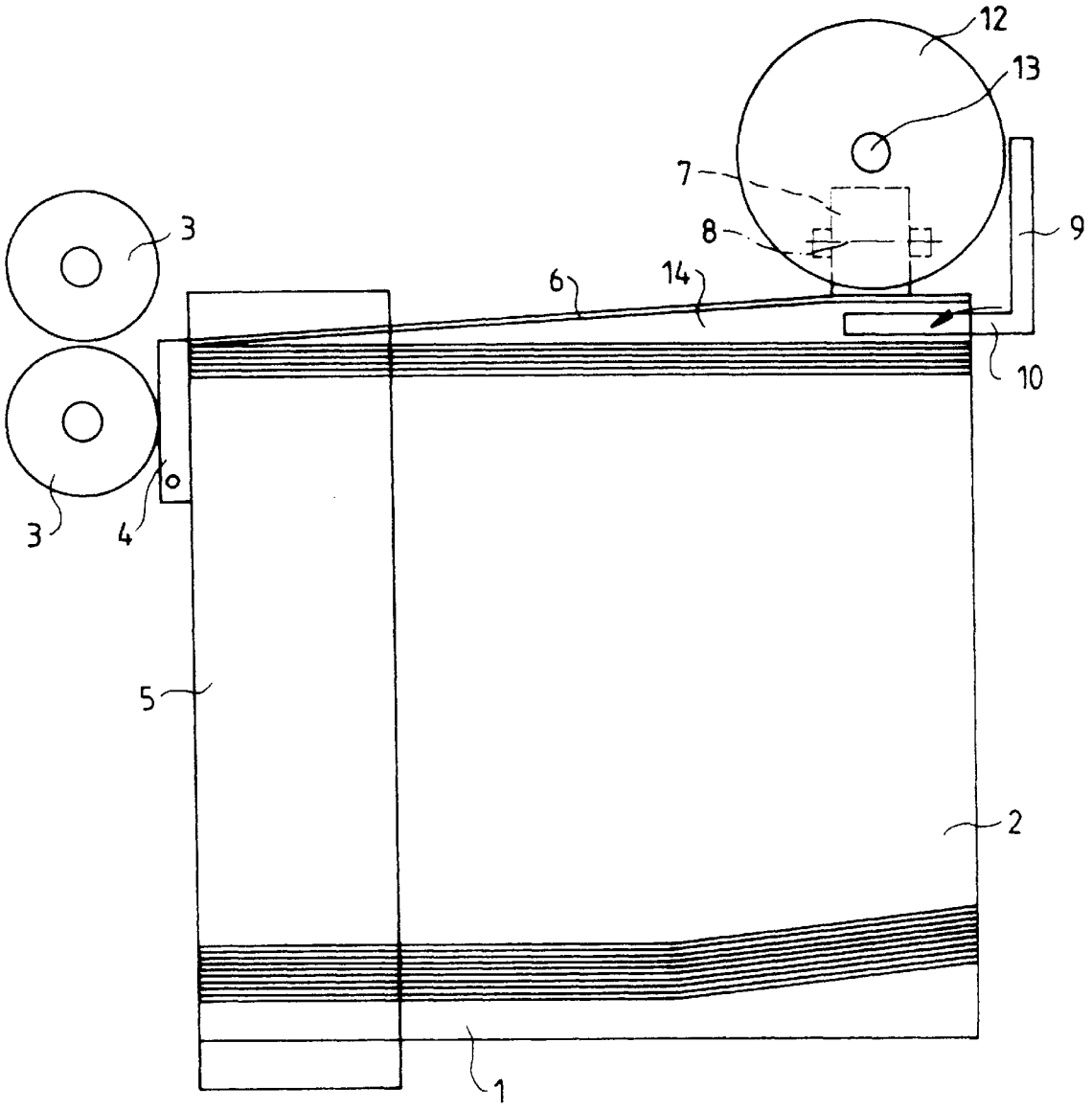

As is apparent, for example, from FIG. 2, the sheet support board 1 is flat or planar in the front and middle regions thereof. In the vicinity of the two rear corners of the sheet support board 1, i.e., the corners of the sheet support board 1 facing away from the printing press, of which only the transport rollers 3 are shown, for example, in FIG. 2, the upper side of the sheet support board 1 is formed so that it slopes up from the planar or flat portion thereof to the rear corners thereof. Thus, the sheet support board 1 is formed with an at least partly concave upper side. The sheet pile 2 resting on the sheet support board 1 essentially assumes the same form as that of the board 1 so that the two rear upper corners of the sheet pile 2 are higher than the remaining surface thereof.

Above the uppermost sheet 6 of the sheet pile 2, a respective friction wheel 7 is disposed in the vicinity of the two rear corners, each of the friction wheels 7 having an axial shaft 8 extending parallel to the lateral edges of the sheet 6. By suitable non-illustrated resilient elements, the friction wheels 7 are resiliently pre-loaded in a direction towards the upper side of the uppermost sheet 6 so that the friction wheels 7 are resiliently deflectable upwards. The position of the friction wheels 7 and, accordingly, the upper pile edge are detectable by non-illustrated sensors in order to keep the upper side of the sheet pile 2 at the same height during machine operation by moving the sheet support board 1. The friction wheels 7 then exert a defined force onto the rear corners of the respective uppermost sheet 6. For the purpose of turning the friction wheels 7, the shafts 8 of the friction wheels 7 are connected to non-illustrated driving devices.

A governor or feeler foot 9 having an elongated governor or feeler finger 10 extending approximately parallel to the upper side of the sheet pile 2 is disposed at the trailing edge of the sheet pile 2. By pivoting the governor foot 9 about a pivot point 11 located in the plane of drawing of FIG. 2, the governor foot 9 is movable towards and away from the sheet pile 2. Alternatively, the governor foot 9 may be movable linearly or may be pivotable about a pivot point disposed in the plane of the upper side of the sheet pile 2. A suitable non-illustrated drive is provided for moving the governor foot 9.

A friction wheel 12 having an axial shaft 13 is provided between the two friction wheels 7, the shaft 13 extending parallel to the trailing edge of the sheet pile 2. The friction wheel 12 is located precisely above the governor finger 10 of the governor foot 9, when the governor foot 9 has been pivoted towards the sheet pile 2. The friction wheel 12 and the shaft 13 thereof are movable from above towards the sheet pile 2 and the governor finger 10, respectively, and away therefrom. Suitable non-illustrated drives are provided for executing these movements and for turning the friction wheel 12.

During the operation of the feeder system, the friction wheels 7 are initially rotated in mutually opposite directions, as indicated by the curved arrows in FIG. 1, so that the uppermost sheet 6 is stretched and subjected to tension between the friction wheels 7. In this manner, an interspace 14 is formed between the two uppermost sheets of the sheet pile 2. In order to ensure a reliable separation of only a single sheet from the sheet pile 2, even when using delicate papers such as, for example, very thin sheets, it is conceivable to provide, at the side of the governor foot 9, non-illustrated stripping springs or stripping brushes which press against the trailing edge of the sheet pile 2.

In this condition, a side sectional view of which is shown in FIG. 2, the governor foot 9 pivots in a contact-free manner from the rear into the interspace 14 which has been formed. Due to this pivoting motion, the governor foot 9 assumes the position thereof represented in FIG. 3, wherein the governor finger 10 extends into the interspace 14 beyond a perpendicular center line of the friction wheel 12. The governor foot 9 is then lowered below the uppermost sheet 6 onto the sheet pile 2 in order to retain or hold down the remaining sheets on the sheet pile 2. This lowering motion may be performed separately, as indicated by the vertically downwardly directed arrow associated with the governor foot 9 in FIG. 4, or may be the result of the pivoting motion of the governor foot 9 for an appropriate selection of the location of the pivot point 11.

Figure 4:
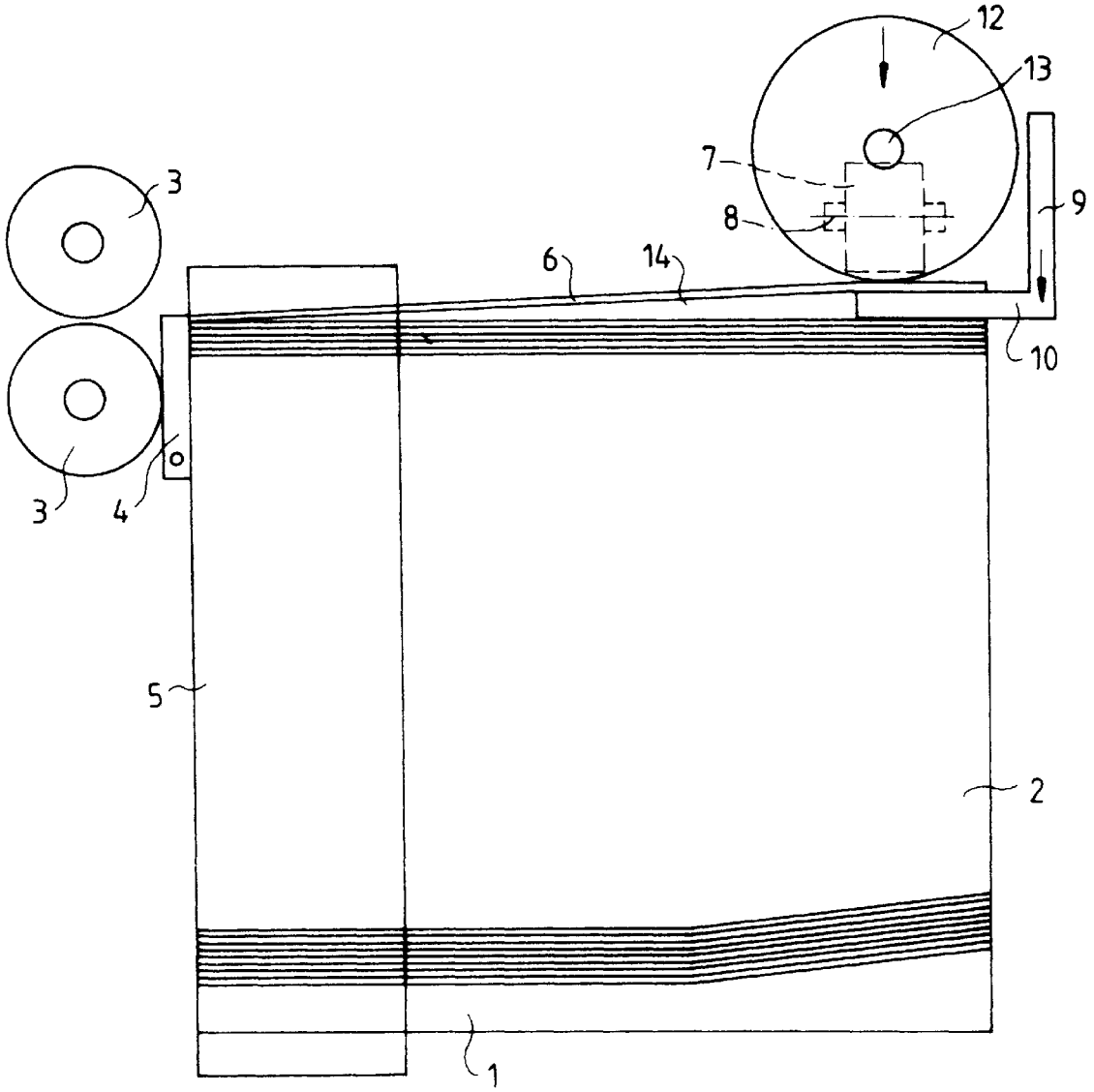
Figure 5:
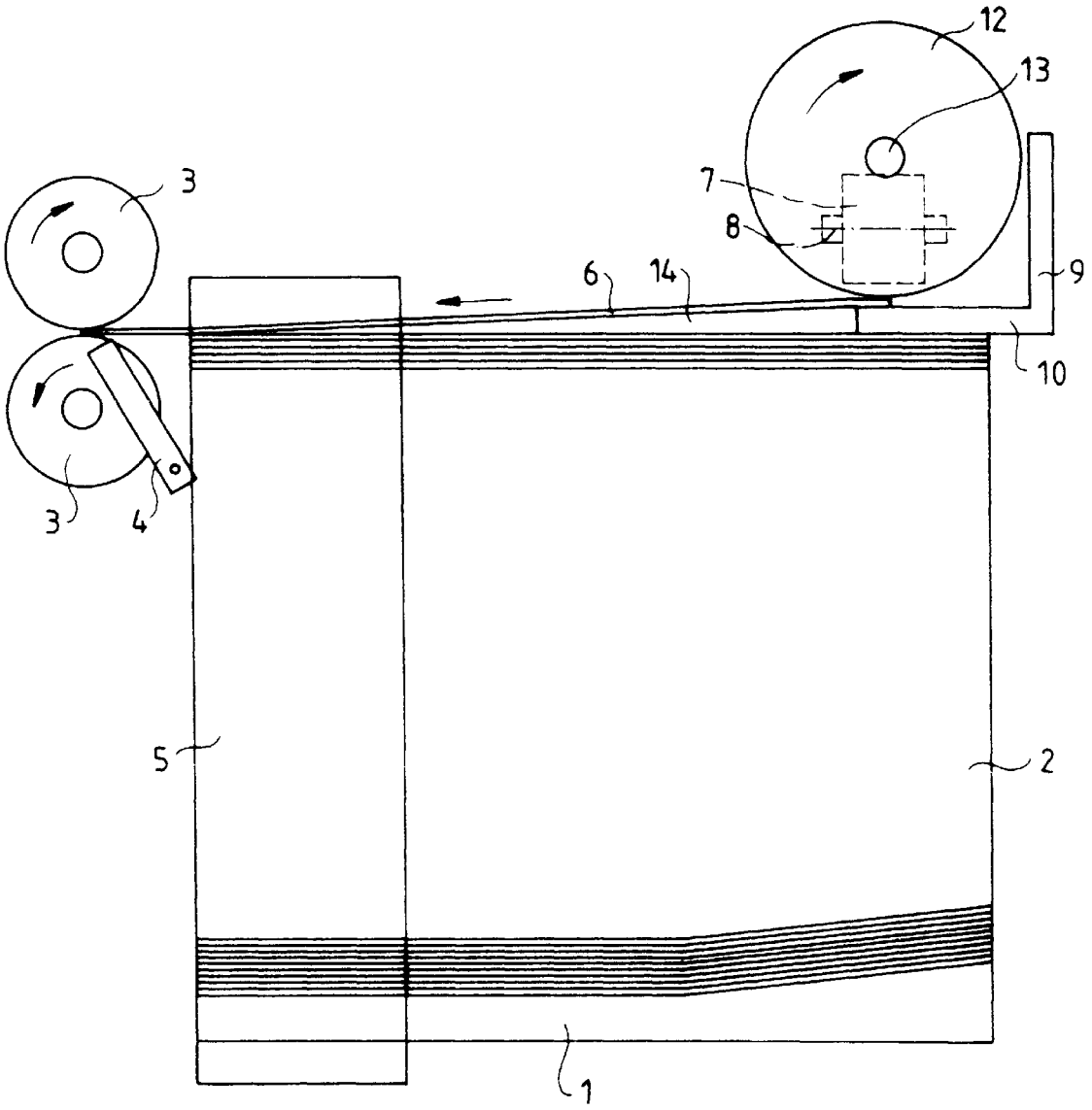
Figure 6:
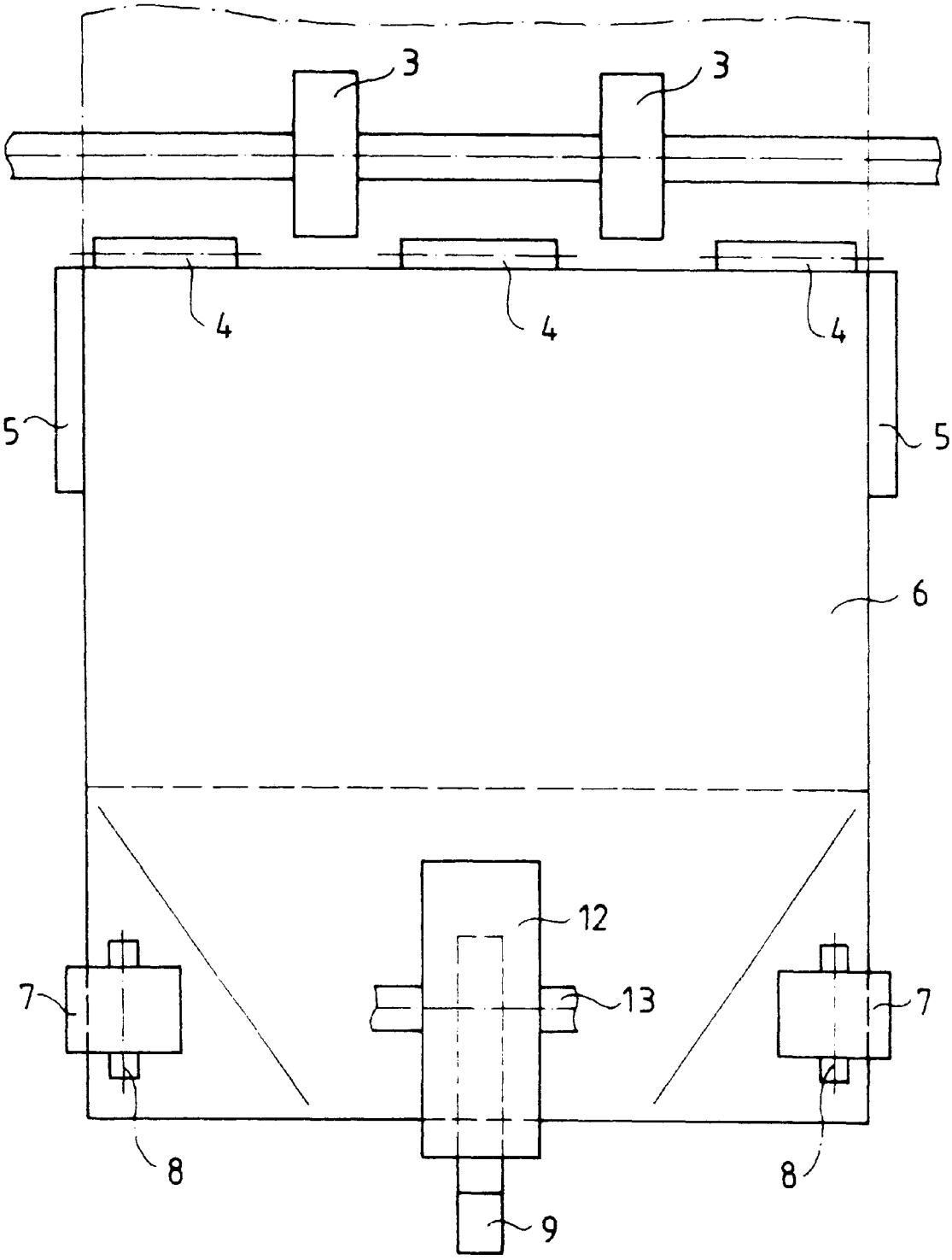
FIG. 6 is a diagrammatic top plan view of the feeder system of FIG. 1.

Simultaneously with the lowering of the governor foot 9 onto the sheet pile 2, or shortly thereafter, the friction wheel 12 is lowered, as represented in FIG. 4 by another vertically downwardly directed arrow associated with the friction wheel 12, the uppermost sheet 6 being clamped between the friction wheel 12 and the governor finger 10. As shown in FIG. 5, the movable pile stops 4 are then pivoted away from the sheet pile 2, and the friction wheel 12 is turned in the direction indicated by the curved arrow.

The upper side of the governor finger 10 may, for example, be a polished metal surface which has a lower friction coefficient than the friction wheel 12 with respect to the sheet 6. The uppermost sheet 6 is thereby pushed forward towards the transport rollers 3. In order to facilitate this action, the friction wheels 7 may meanwhile be lifted off the sheet 6 by suitable non-illustrated devices. It is also conceivable, however, to pre-load the friction wheels 7 only slightly so that the sheet transport is not hampered.

The length of the governor finger 10 and the distance of the transport rollers 3 from the sheet pile 2, respectively, are selected so that the uppermost sheet 6 is seized by the transport rollers 3 at the very time it departs from between the friction wheel 12 and the governor finger 10.

The instant the uppermost sheet 6 departs from between the friction wheel 12 and the governor finger 10 of the governor foot 9, the friction wheel 12, the governor foot 9 and possibly the friction wheels 7 are returned to the positions thereof indicated in FIG. 2. Thereafter, a new separating cycle can start immediately, while the sheet 6 is still being drawn off the sheet pile 2, wherein it is located, for example, in the position represented in FIG. 6 by broken lines. While the sheet 6 is being drawn off the sheet pile 2, the sheet 6 is guided by the lateral pile stops 5.

The tensioning of the uppermost sheet and the intervention into the interspace which is produced may not only be effected at the trailing sheet edge but alternatively, or additionally, also at the lateral edges of the sheet. Furthermore, the intervention may be effected at the leading edge of the sheet as described hereinafter with reference to FIG. 7.

Figure 7:
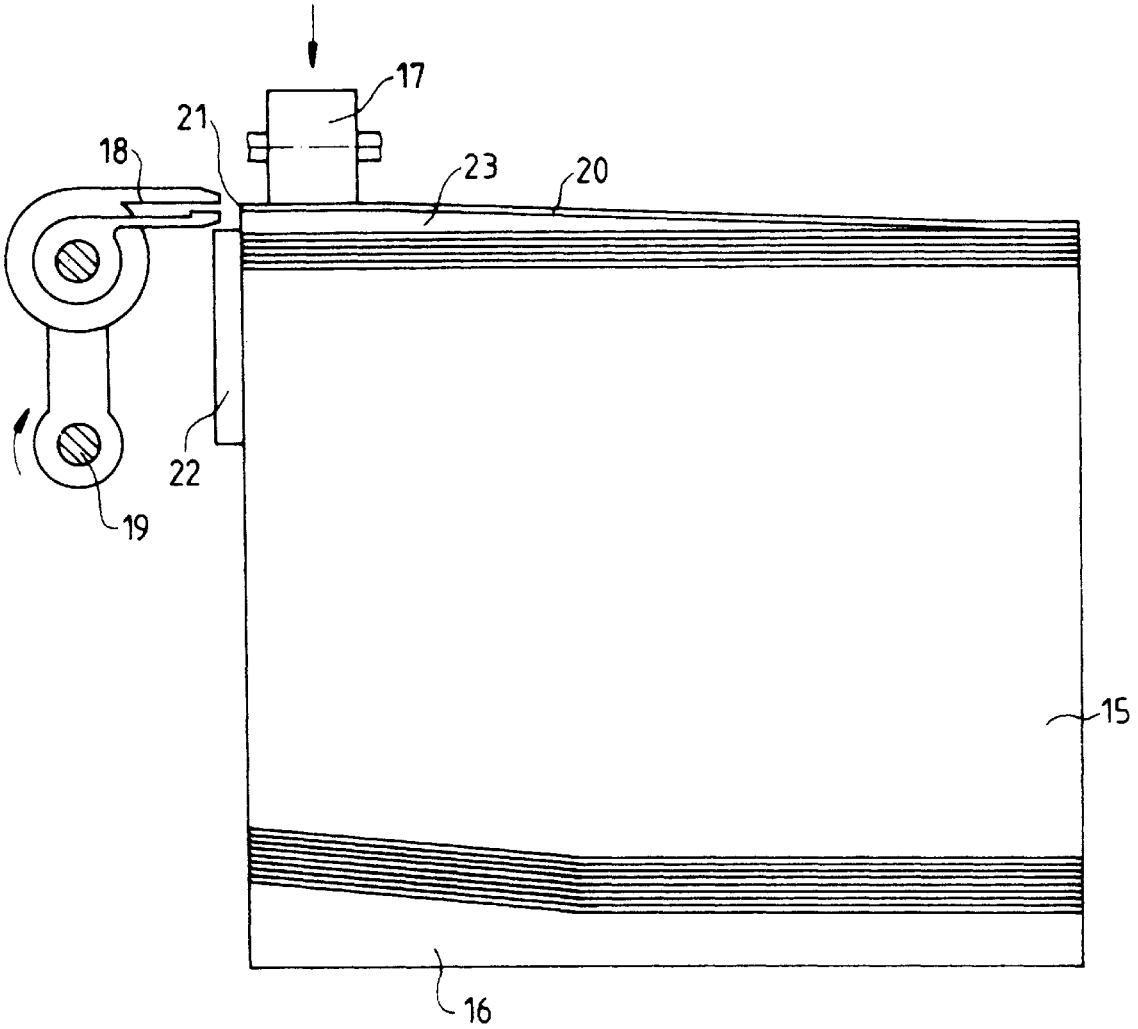
FIG. 7 is a diagrammatic longitudinal sectional view of another embodiment of a sheet feeder system for a sheet-fed printing press according to the invention.

In the embodiment of the invention shown in FIG. 7, a concaveshaped sheet support board 16 is provided which causes a sheet pile 15 to sag in a corresponding concave-shaped manner in a front region of the sheet pile 15. Two friction wheels 17 of the embodiment of FIG. 7 correspond to the friction wheels 7 of the embodiment of FIGS. 1 to 6 both as to the construction and function thereof, however, they are arranged above the front corners of the sheet pile 15 rather than the rear corners thereof. One or more grippers 18 are disposed on a rotatable gripper bar 19 provided in front of the sheet pile 15.

After the friction wheels 17 have applied tension to the uppermost sheet 20 of the sheet pile 15 in accordance with the principle shown in FIG. 1, the grippers 18 pivot to the leading edge 21 of the uppermost sheet 20, seize the sheet 20 at the leading edge 21 thereof and draw the sheet 20 off the sheet pile 15 in order to feed it to a printing press. The remaining sheets are retained or held back by a front pile stop 22 over which the respective uppermost sheet 20 is lifted, when the interspace 23 is formed between the two uppermost sheets. Moreover, stripping springs or stripping brushes may be provided laterally beside the front pile stop 22.

The embodiment of the sheet feeder system represented in FIG. 7 does not permit operating speeds which are as high as those of the preceding embodiment, because the sheets cannot be drawn off the sheet pile in a shingled or overlapping manner. On the other hand, the embodiment of FIG. 7 requires only very few moving parts, the respective masses of which may kept small so that the operating speeds of conventional single-sheet feeders may easily be achieved or even exceeded, without the occurrence of any excessive accelerations and consequent vibrations. Moreover, the sheet separation is much more reliable due to the fact that the uppermost sheet is subjected to tension, with essentially less effort and expense and with considerably less noise than for conventional single-sheet feeders operating with air.

Figure 8:
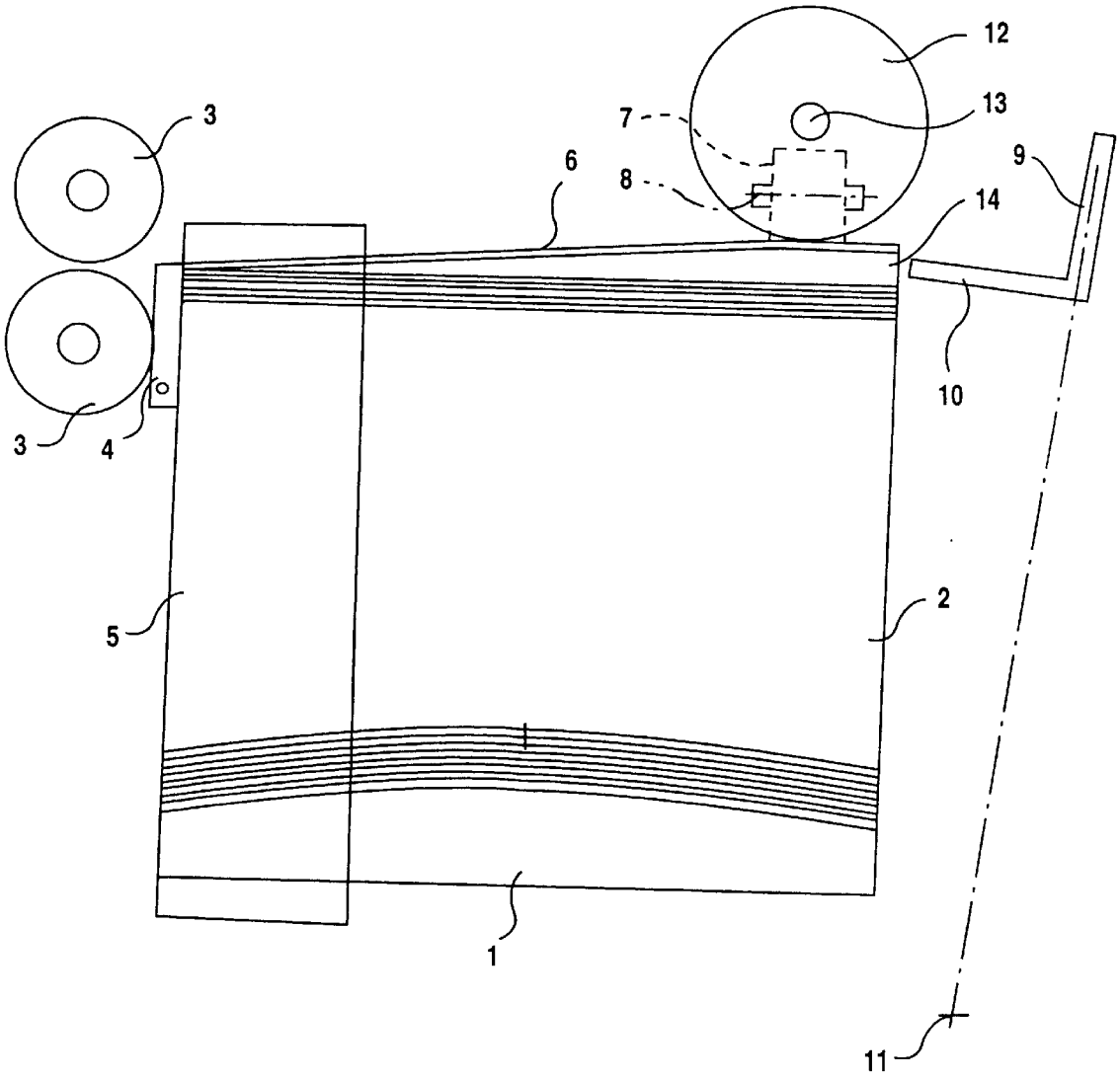
FIG. 8 is a diagrammatic sectional view showing a sheet support board having a convex shape.

FIG. 8 shows the invention as shown in FIGS. 1–5 but with a sheet support board having a convex shape instead of a concave shape.

We claim:

1. Sheet feeder system for a sheet-fed printing press, comprising:

a device for causing a sheet pile to sag at least partly in at least an upper region thereof;

at least two contact elements disposed in a mutually spaced-apart relationship on an upper side of the sheet pile and having respective contact surfaces for pressing against the upper side of the sheet pile at least partly or temporarily, at least one of said contact elements being drivable so as to move the respective contact surfaces pressing against the upper side of the sheet pile towards and away from one another, respectively, for forming an interspace between the uppermost sheet of the sheet pile and a sheet immediately therebelow;

a friction wheel; and a device engaging in said interspace formed between the uppermost sheet and the sheet immediately therebelow, said device engaging in said interspace having at least one governor finger being movable into said interspace in a contact-free manner and being lowerable onto the sheet immediately below the uppermost sheet, said at least one governor finger having a low-friction surface forming a counterpressure device for said friction wheel, said friction wheel being disposed above said at least one governor finger, and said friction wheel being lowerable onto the uppermost sheet for transporting the uppermost sheet in a direction towards a feeder of the printing press.

2. Sheet feeder system according to claim 1, wherein said feeder of the printing press includes at least one pair of transport rollers disposed proximately to said sheet pile.

3. Sheet feeder system according to claim 1, wherein said contact elements are friction wheels pre-loaded in a direction towards the upper side of said sheet pile.

4. Sheet feeder system according to claim 3, wherein:

said friction wheel being disposed above said at least one governor finger is a first friction wheel;

said friction wheels pre-loaded in a direction towards the upper side of said sheet pile are second friction wheels; and a respective one of said second friction wheels is disposed on each side of said sheet pile proximate to trailing edges of the sheets, and said second friction wheels are drivably supported on respective shafts extending transversely to the trailing edges of the sheets.

5. Sheet feeder system according to claim 1, wherein said device for causing said sheet pile to sag is a sheet support board having an at least partly concave shape.

6. Sheet feeder system according to claim 1, wherein said device for causing said sheet pile to sag is a sheet support board having an at least partly convex shape.

7. Method of individually separating sheets piled on top of one another in a feeder of a sheet-fed printing press, which comprises:

causing a sheet pile to sag at least partly in at least an upper region thereof, stretching or contracting an uppermost sheet of the sheet pile in the sagging region of the sheet pile by mechanical contact at the upper sheet side so as to form an interspace between the uppermost sheet of the sagging sheet pile and the sheet immediately therebelow; and forming the interspace on a side of the sheet pile which is remote from the feeder of the sheet-fed printing press, engaging in the interspace formed between the uppermost sheet and the sheet immediately therebelow so as to retain the respective sheet below the uppermost sheet, mechanically conveying the uppermost sheet in a direction towards the printing press and transferring the uppermost sheet to the printing press, and beginning the foregoing steps anew while the last Individually separated sheet is still being drawn off the sheet pile.

8. Method according to claim 7, wherein the sheet pile sags in a concave manner, and which includes pressing with at least one contact element on each side of the sheet pile against the upper side of the uppermost sheet, and laterally moving away from one another the surfaces of the contact elements pressing against the uppermost sheet so as to apply tension to the uppermost sheet.

9. A sheet feeder system for a sheet-fed printing press, comprising:

a device for causing a sheet pile to sag at least partly in at least an upper region thereof; and at least two contact elements disposed in mutually spaced-apart relationship on an upper side of the sheet pile and having respective contact surfaces for pressing against the upper side of the sheet pile at least partly or temporarily, at least one of said contact elements having an axis extending transversely to trailing sheet edges of sheets of the sheet pile and being drivable so as to rotate said at least one of said contact surfaces about said axis, said at least one of said contact surfaces rotating about said axis pressing against an upper side of the sheet pile for forming an interspace between the uppermost sheet of the sheet pile and a sheet immediately therebelow.

10. Sheet feeder system according to claim 9, including at least one movable gripper for seizing the uppermost sheet and drawing it off the sheet pile, at least a portion of said gripper being operable in the interspace.

* * * * *